United States Patent [19]

Russell

[11] 4,071,063

[45] Jan. 31, 1978

[54] NON-RELEASABLE HAND GRIP FOR PACKAGE OR LOOP HANDLE OF A BAG

[75] Inventor: Frank B. Russell, Chicago, Ill.

[73] Assignee: Swift & Company, Chicago, Ill.

[21] Appl. No.: 795,893

[22] Filed: May 11, 1977

Related U.S. Application Data

[63] Continuation-in-part of Ser. No. 697,141, June 17, 1976, abandoned.

[51] Int. Cl.[2] ..... B65D 63/18

[52] U.S. Cl. ..... 150/12; 229/52 R; 229/54 R; 229/62; 16/114 R; 224/45 P

[58] Field of Search ..... 229/52 A, 52 AM, 54 R, 229/62, 65, 52 AC, 54 C; 150/12; 16/114 R, 124; 224/45 R, 45 A, 45 AA, 45 P, 45 H, 45 W, 50, 56

[56] References Cited

U.S. PATENT DOCUMENTS

| | | | |
|---|---|---|---|
| 3,664,575 | 5/1972 | Lake | 229/62 |
| 3,912,140 | 10/1975 | Franges | 229/54 R X |

FOREIGN PATENT DOCUMENTS

| | | | |
|---|---|---|---|
| 506,468 | 11/1951 | Belgium | 229/54 R |
| 706,737 | 3/1965 | Canada | 229/54 R |
| 2,255,657 | 5/1973 | Germany | 229/62 |
| 479,274 | 11/1969 | Switzerland | 229/54 R |
| 561,523 | 5/1975 | Switzerland | 229/54 R |
| 1,088,414 | 10/1967 | United Kingdom | 229/62 |

*Primary Examiner*—Robert S. Ward, Jr.
*Attorney, Agent, or Firm*—Edward T. McCabe; Charles E. Bouton

[57] ABSTRACT

A hand grip comprised of hinged semi-cylindrical portions with internal latch means is fastened about a loop handle of a package.

14 Claims, 7 Drawing Figures

NON-RELEASABLE HAND GRIP FOR PACKAGE OR LOOP HANDLE OF A BAG

This is a continuation-in-part of my prior copending U.S. patent application Ser. No. 697,141, filed June 17, 1976 and now abandoned.

This invention relates to a substantially tubular hand grip member that is securable to string, rope or soft fabric type package handles, and more particularly is directed to a hand grip member that is securable to the soft loop handle of a netting-type food bag and which hand grip is substantially non-releasable after being secured to said handle.

A number of hand grips have been devised for the comfort of a person carrying a string tied package or a string handle shopping bag or a bucket bail or the like. For the most part those grips have been designed to be releasabe or detachable so that they could be reused by the carrier with other packages. Some have been permanently affixed to string type handles and bail type devices where the bag or bail is intended for repeated use.

The manner in which the prior art hand grip devices have been used has been simply to make more comfortable a handle that previously existed. The prior devices have not made the handle more accessable and, although the grips themselves could be marked with identifying legends, they have not contributed any new functions to the package.

Furthermore a number of years ago a plastic netting material in tubular form became available at low cost. Subsequently that material came into wide use to enwrap food products such as frozen turkeys. Often the netting is used to form an outer bag for such products and the bag thus formed, by crimpling closed the two ends of the tube with the food product therebetween, included a handle loop made by gathering and twisting an extension of the netting at one end into a rope like form and doubling it over and fastening it to itself. However the loop thus formed, while of comfortable thickness, has a narrow opening and is difficult to grasp by more than a couple of fingers. The loop thus formed is often hard to see against the netting enclosed product. Also the products bagged are most often heaped together in bins, or the like, with product of differing size and weight, and of different manufacturers. Thus the consumer has found it difficult to identify the desired size and make of product and to find and grasp the handle so as to remove the product from a display bin.

The retailers of products thus packaged have also had difficulty in affixing a price tag thereto. Many products are not marked with the retail price until the retailer receives and accurately weighs them. It is then important that individual price tags be permanently attached to specific items of product in a prominent and highly visible manner.

Accordingly it is a principle object of the present invention to provide an improved package hand grip that may be permanently secured to a package.

It is another object of the present invention to provide an improved hand grip that may be permanently and easily secured to hold open a handle loop of soft rope-like material.

It is still another object of the present invention to provide an improved hand grip having a means to attach a price tag or the like.

It is yet another object of the present invention to provide an improved handle for bags of netting wherein the handle is a loop of gathered netting and is held open and made highly visible by a substantially tublar hand grip secured to the mid portion of said loop.

Basically the present invention involves the application of a rigid hand grip to the gathered and looped end of a product package where the hand grip is of a color that differs markedly from that of the package. More precisely the hand grip is formed of two semi-cylindrical portions that are hinged together along one edge and have internal fasteners along the opposite edges so as to present a smooth tubular exterior when fastened about the gathered package handle, which is preferably a loop handle. One form of the hand grip includes a filament extension having a normally free and that is fastenable to the hand grip so as to secure a tag thereto.

Other objects and advantages will become apparent upon reading the following detailed description of the invention in conjunction with the drawings, wherein:

FIG. 5 is an exterior plan view of a second embodiment of a hand grip having an extension for securing a tag or the like;

Figure 1:
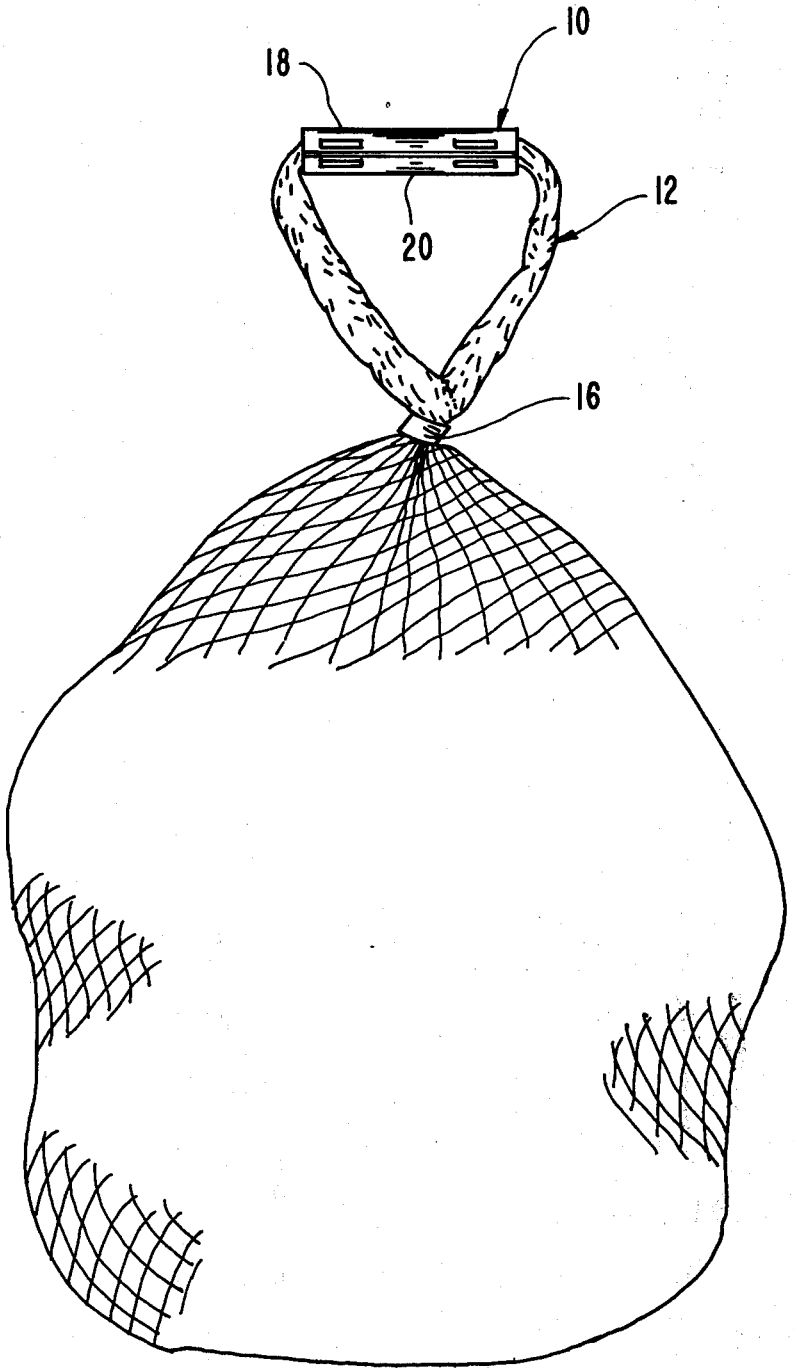
FIG. 1 is an overall view of an embodiment of the present invention showing a hand grip secured to a loop handle made of gathered netting.

In a broad sence the present invention, as seen in FIG. 1, comprises a smooth tubular hand grip generally 10 for completely encircling a central portion of gathered material forming a loop handle generally 12 which is secured at the end of a package by a crimped fastener 16. The hand grip is formed of two semi-cylindrical portions 18, 20 being hinged together along adjacent edges 22, 24 and having internal latch means generally adjacent the opposite outer edges. The internal structure of the latch means 26 enables the exterior of the hand grip 10 to be smooth and comfortable to grip by a consumer; and also prevents the hand grip 10 from being detached from the handle 12 once it has been placed thereon.

Preferably the hand grip 10 is formed of a material in a color that highly contrasts with the color of the package and handle 12 material and thus will be highly visible and attractive to the potential consumer. Also the hand grip should be about 21/2 to 31/2 inches long so as to accommodate the hands of most consumers. When hand grips within the foregoing size range are affixed to looped handles formed of gathered plastic netting, as commonly used to package frozen turkeys, it will also be found that the resultant handle with hand grip tends to extend more prominently from the product so as to be a primary visual feature of the package as well as more readily graspable by the consumer.

Thus in application to product it has been found that the hand grips may serve to identify the manufacturer of certain product; and where a limited assortment of colors are utilized in the hand grips they may also serve to identify the weight range of various product items.

For example in the marketing of frozen turkeys it is possible to identify carcasses of six to ten pounds with an orange hand grip; those of ten to sixteen pounds with a green hand grip; those of sixteen to twenty pounds with a blue hand grip; and those of twenty to twenty-four pounds with a red hand grip.

Figure 2:
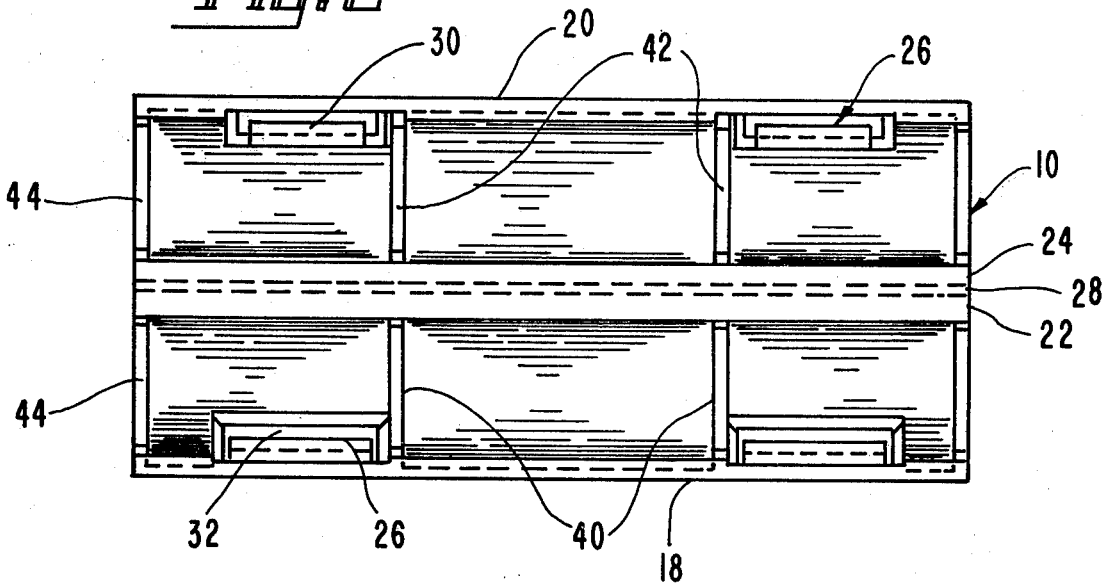
FIG. 2 is an interior plan view of a hand grip device in open condition before being secured to a handle.
Figure 3:
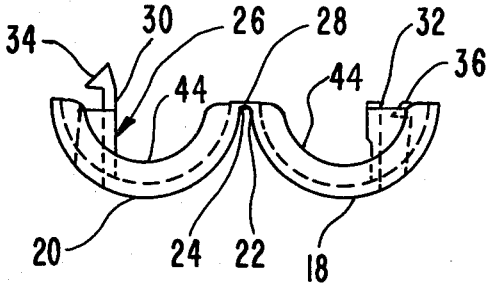
FIG. 3 is an end view taken from the left end of the device shown in FIG. 2.
Figure 4:
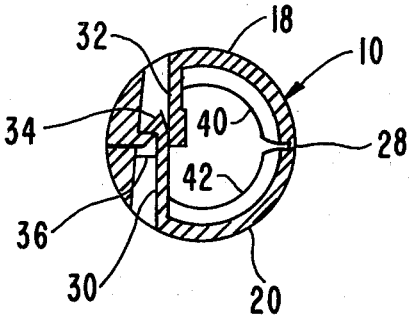
FIG. 4 is a section view of the device of FIGS. 2 and 3 when closed.

A form of hand grip 10 is shown in FIGS. 2 through 4. The two semi-cylindrical portions 18, 20 are die molded of plastic material, such as high density polyethylene, as a single integral unit with a thin connecting web 28 of plastic forming a hinge between longitudinal edges 22 and 24. The two semi-cylindrical portions 18, 20 are substantially symetrical about the web 28 except that the exact form of the internal latch means 26 requires a male member 30 on one portion 20 and a female member 32 on the other portion 18. Preferably two such members are incorporated in each portion. As may be best seen in FIGS. 3 and 4 each male latch member 30 terminates in an outwardly disposed pawl 34; and each female latch member 32 includes an inwardly disposed detent 36 which will grip the pawl 34, once it is inserted past the detent 36, and effectively prevent its withdrawal. Thus when the two semi-cylindrical portions 18, 20 of the hand grip, generally 10, are closed and pressed together the latch means generally 26 will engage and prevent separation. Since the latch members are inside the hand grip generally 10, the device cannot be readily separated once closed.

It may be desirable to strengthen the semi-cylindrical portions 18, 20 with annular internal ribs 40, 42 and similar ribs 44 at the ends thereof. Such ribs also function to securely grip and compress the loop handle 12 and thereby prevent the hand grip 10 from sliding thereon.

Figure 5:
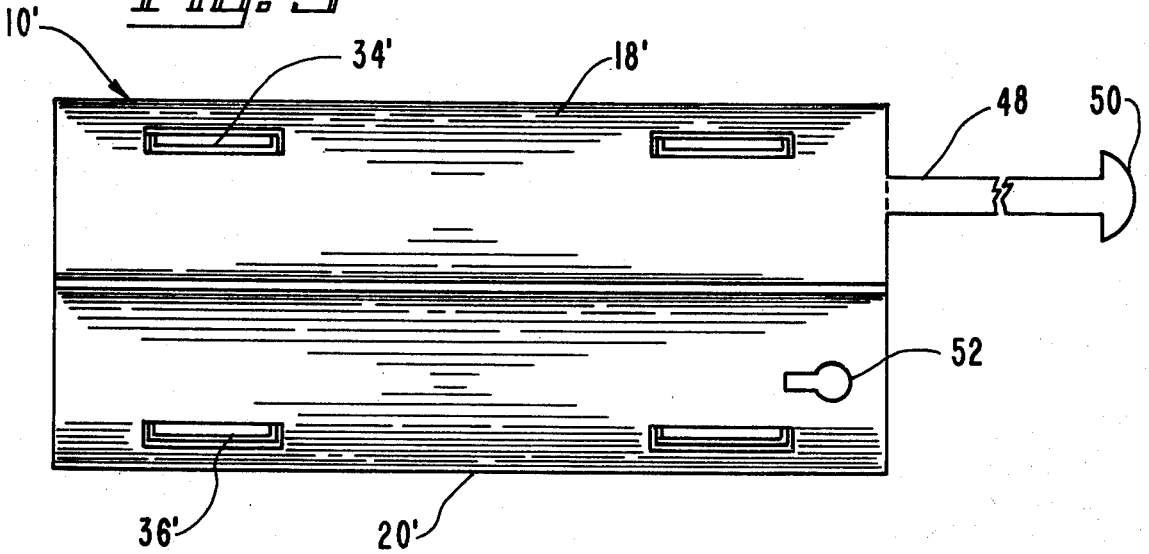

Another similar embodiment of the present invention is shown in FIG. 5 wherein parts similar to those of the device shown in FIGS. 2–4 are denoted by similar reference characters bearing a prime (') notation. In this embodiment the two semi-cylindrical portions 18', 20' of the hand grip 10' are substantially identical to that described heretofore except that in addition there is an extension filament 48 fixed to one such portion 18' or 20'. Preferably the filament 48 is integrally formed with one portion 18'.

The filament 48 is of small cross section and about 1½to 2 inches long and the free end there of preferably terminates in an enlarged key 50. The filament is intended to secure a tag, such as for weight and price information, to the hand grip 10'. Separate locking means may be provided to receive the free end of filament 48. Accordingly after a tag is inserted or impaled on the filament 48 by a retailer or the like, and usually after the hand grip 10' has been secured to the handle 12, the key 50 is then twisted and inserted in a key way 52 formed in one of the same cylindrical portions 18', 20', preferably at the same end as filament 48.

Figure 6:
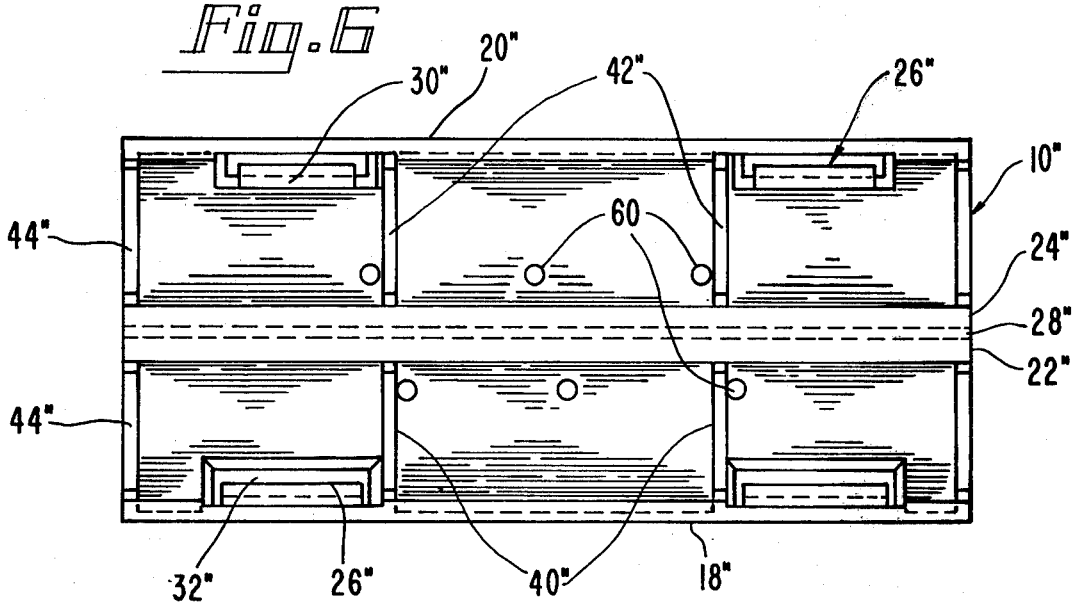
FIG. 6 is an interior plan view similar to FIG. 2 of a further preferred embodiment of a hand grip.
Figure 7:
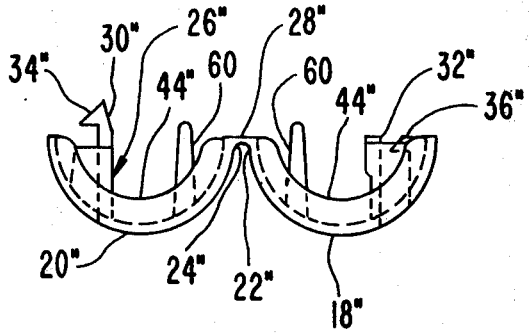
FIG. 7 is an end view taken from the left end of the device shown in FIG. 6.

A most preferred internal structure for hand grips in accordance with this invention is shown in FIGS. 6 and 7 wherein parts similar to the device shown in FIGS. 2–4 are denoted by similar reference characters bearing a double prime (") notation. In this embodiment the loop handle 12 will be even more positively engaged to prevent slipage between it and the grip member 10" by means of a plurality of pins 60 which are formed on the concave surfaces of semi-cylindrical portions 18" and 20" so as to extend inwardly when the grip 10" is closed. These pins may be conveniently located near the anular internal ribs 40", 42", and preferably extend beyond the level of the edges 22" and 24" so that when the grip 10" is closed the pins 60 extending from opposite portions 18" and 20" will overlap. Also the pins 60 are preferably located on both portions 18" and 20" and approximately opposing pairs that will be closely adjacent one another when the grip 10" is closed but will not interfere with one another.

Obviously many modifications and variations of the invention as hereinbefore set forth may be made without departing from the spirit and scope thereof, and, therefore, only such limitations should be imposed as are indicated in the appended claims.

I claim:

1. An improved hand grip for use on packages having a handle means, said hand grip comprising: a pair of semi-cylindrical portions, said portions being hinged together along a pair of adjacent edges, the convex surfaces of said portions being relatively smooth; and latch means formed on the concave surfaces of said portions adjacent the opposite edges of said portions, said latch means including at least one male member terminating in a pawl and at least one female member having a detent arranged to receive and non-releasably engage said pawl whereby said latch means cooperate to substantially permanently secure said semi-cylindrical portions together when said portions are closed about said handle means.

2. The improved hand grip of claim 1 wherein said pair of semi-cylindrical portions are formed of plastic with a narrow connecting web of plastic material joining said portions along adjacent edges to form a hinge means.

3. The improved hand grip of claim 2 wherein said pair of semi-cylindrical portions are integrally formed by molding and said connecting web is integrally formed therewith.

4. The improved hand grip of claim 1 wherein said semi-cylindrical portions contain internal annular ribs.

5. The improved hand grip of claim 1 wherein at least one pin extends inwardly from each of said portions.

6. The improved hand grip of claim 5 wherein each pin extends inwardly beyond the level of said edges.

7. The improved hand grip of claim 6 wherein the pins are paired and substantially oppositely disposed on said portions so as to be adjacent and overlap one another.

8. The improved hand grip of claim 1 wherein one of said semi-cylindrical portions contains a pair of said male latch members spaced from one another, and the other of said portions contains a pair of said female latch members spaced from one another and arranged to receive said pair of male members when said portions are closed together.

9. The improved hand grip of claim 1 in combination with a handle of gathered netting type package wrapper material formed into a loop wherein said semi-cylindrical portions are of a highly visible color differing from the color of the package wrapper material and wherein said portions are closed about a central portion of said loop and thereby hold the handle open to be readily graspable by a consumer.

10. The improved hand grip of claim 1 wherein one end of an extension filament is fixed to one end of one of said semi-cylindrical portions.

11. The improved hand grip of claim 10 wherein said extension filament terminates in an enlarged key.

12. The improved hand grip of claim 11 including a locking means thereon to receive a free end of said extension filament.

13. The improved hand grip of claim 12 wherein said locking means is a key-way formed at said one end of a semi-cylindrical portion to receive and retain said key.

14. The improved hand grip of claim 13 in combination with a handle of gathered netting type package wrapper material formed into a loop wherein said semi-cylindrical portions are of a highly visible color differing from the color of the package wrapper material and wherein said portions are closed about a central portion of said loop and thereby hold the handle open to be readily graspable by a consumer.

* * * * *